US006648446B1

(12) United States Patent
Rutland et al.

(10) Patent No.: US 6,648,446 B1
(45) Date of Patent: Nov. 18, 2003

(54) SMUDGE-RESISTANT INK JET PRINTING

(75) Inventors: Jeffrey D. Rutland, San Diego, CA (US); David E. DeBellis, Camas, WA (US); Brooke E. Smith, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/133,848

(22) Filed: Apr. 25, 2002

(51) Int. Cl.[7] ..... B41J 2/015

(52) U.S. Cl. ..... 347/21; 347/37; 347/102

(58) Field of Search ..... 347/21, 37, 102, 347/212, 98, 96, 101, 100, 103

(56) References Cited

U.S. PATENT DOCUMENTS 4,538,160 A 8/1985 Uchiyama ..... 346/140 R
5,635,969 A 6/1997 Allen ..... 347/96
5,946,012 A 8/1999 Courian et al. ..... 347/63
6,059,406 A 5/2000 Richtsmeier et al. ..... 347/102
6,090,749 A 7/2000 Kowalski ..... 503/227
6,179,414 B1 1/2001 Keefe et al. ..... 347/65
6,227,640 B1 5/2001 Maze et al. ..... 347/15
6,357,845 B1 * 3/2002 Kuwabara et al. ..... 347/105
6,464,349 B1 * 10/2002 Moriyama et al. ..... 347/101

* cited by examiner

*Primary Examiner*—Stephen D. Meier
*Assistant Examiner*—Julian D. Huffman

(57) ABSTRACT

The following described arrangements and procedures generate a smudge resistant image with an ink jet imaging device. Specifically, in an image printing zone on the ink jet imaging device, a first carriage generates an image on a print medium. Then, in an image protecting zone on the ink jet imaging device, a second carriage deposits an overcoat solution and a fixer solution onto the image to form a substantially smudge resistant image.

2 Claims, 4 Drawing Sheets

SMUDGE-RESISTANT INK JET PRINTING

TECHNICAL FIELD

The following subject matter relates to ink jet imaging mechanisms. More particularly, the following arrangements and procedures pertain to protecting images formed on a print media substrate.

BACKGROUND

Printers are imaging devices that print onto a printing medium such as a sheet of paper or a polyester film. Printers of many types are available and are commonly controlled by a computer that supplies the images in the form of text or figures that are to be printed. One type of imaging device is the ink jet printer, which forms small droplets of ink that are ejected toward the printing medium in a pattern of dots or pixels that form the images.

An ink jet printer typically has a large number of individual colorant-ejection nozzles in a printhead. A printhead is supported in a carriage and oriented in a facing, but spaced-apart, relationship to the printing medium. The carriage and supported printhead traverse over the surface of the medium with the nozzles ejecting droplets of colorant at appropriate times under command of the computer or other controller to produce a swath of ink droplets.

The printhead typically uses water as the vehicle or solvent to carry the ink or colorant droplets. The droplets strike the medium to form dots that when viewed together form one swath or row of the printed image. The carriage is moved an increment in the direction lateral to traverse (or, alternatively, the printing medium is advanced), and the carriage again traverses the page with the printhead operating to deposit another swath. In this manner, the entire pattern of dots that form the image is progressively deposited by the printhead during a number of traverses of the page.

Good print quality is one of the most important considerations and basis of competition in the ink jet printer-industry. Since an ink jet printer forms images with individual dots, the quality of the image is ultimately dependent upon the quality of each dot and the arrangement of the dots on the print medium. Because of the fashion in which printing occurs, the quality of the dots can have a surprisingly large effect upon the final image quality. Thus, there has existed a need to make dots or images smear-proof or water-fast, and resistant to physical abrasion.

One traditional technique to reduce ink jet image smearing and increase image abrasion resistance includes laminating a clear film over the top of a printed image after the image has been rendered onto an ink receiver. This traditional technique, however, is substantially problematic for a number of reasons. For instance, the lamination process is typically time-consuming and often produces unusable prints or waste due to print handling and/or air bubbles trapped between the laminate and the printed image. Additionally, this conventional technique to reduce ink jet image smearing and increase image abrasion resistance generally increases overall printing and equipment costs due to the extra image lamination sheets and laminating apparatus required.

Another conventional technique to reduce ink jet image smearing and increase image abrasion resistance requires the deposit of a chemical precursor (e.g., a cross-linkable gelatin mixture) on the ink recording medium before depositing the ink on the print medium. This chemical precursor preconditions the print medium to react with other functional chemicals such as aldehydes, acid chlorides, and/or double bond chemicals. These functional chemicals are generally either mixed directly with the ink, or mixed together in a pen separate from the ink pens, and sprayed over the ink to reduce ink drying time, paper cockle, and/or color bleed. Such preconditioning is typically time consuming and very expensive.

Moreover, mixing such functional chemicals with one another in a single pen that is separate from the ink or in combination with the ink is substantially problematic. One problem, for instance, is that such functional chemicals are typically extremely reactive and may react with one another in a hazardous manner—presenting flammability and toxicity issues as well as other health risks both before and after they have even been deposited onto the chemical precursor on the ink receiver. Such hazardous reactions generally require that consumers be appropriately forewarned with visible warning labels.

Additionally, mixing levels of protective polymers that are needed to provide reasonable protective film formation over an image in the same printhead that is used to deposit the ink will typically reduce the reliability of the printhead. This is because mixing a protective polymer with the ink substantially increases the mixture's viscosity. This increased viscosity generally results in undesirable printhead nozzle clogging and thereby reduces printhead reliability. Attempting to avoid such printhead nozzle clogs, conventional systems add only a limited amount of the functional polymer. Unfortunately, this limited amount is typically less than the levels of protective polymers that are needed to provide reasonable reliability or proper protective film formation over an image.

The following described arrangements and procedures address these and other problems with protecting images formed on a print media substrate.

SUMMARY

The following described arrangements and procedures generate a smudge resistant image with an ink jet imaging device. Specifically, in an image printing zone on the ink jet imaging device, a first carriage generates an image on a print medium. Then, in an image protecting zone on the ink jet imaging device, a second carriage deposits an overcoat solution and a fixer solution onto the image to form a substantially smudge resistant image.

BRIEF DESCRIPTION OF THE DRAWINGS

FIG. 2 shows a drying mechanism to dry an image on a print receiver applying overcoat and fixer solutions.

DETAILED DESCRIPTION

Overview

The disclosed arrangements and techniques utilize two non-dye or non-colorant containing pens (i.e., printheads), one colorant or ink overcoat printhead and one fixer solution printhead, to provide a bloom overcoat pattern for smudge-resistant ink jet printing with a substantially high optical density or chroma. Ink colorant droplet smearing and abrasion resistance are a problem for many different types of printers and hence, aspects of this disclosure are suitable for various types of printers. For discussion purposes, however, the arrangements and procedures are described in the context of shuttle-type ink jet printers having a movable carriage.

An Exemplary System

Figure 1:
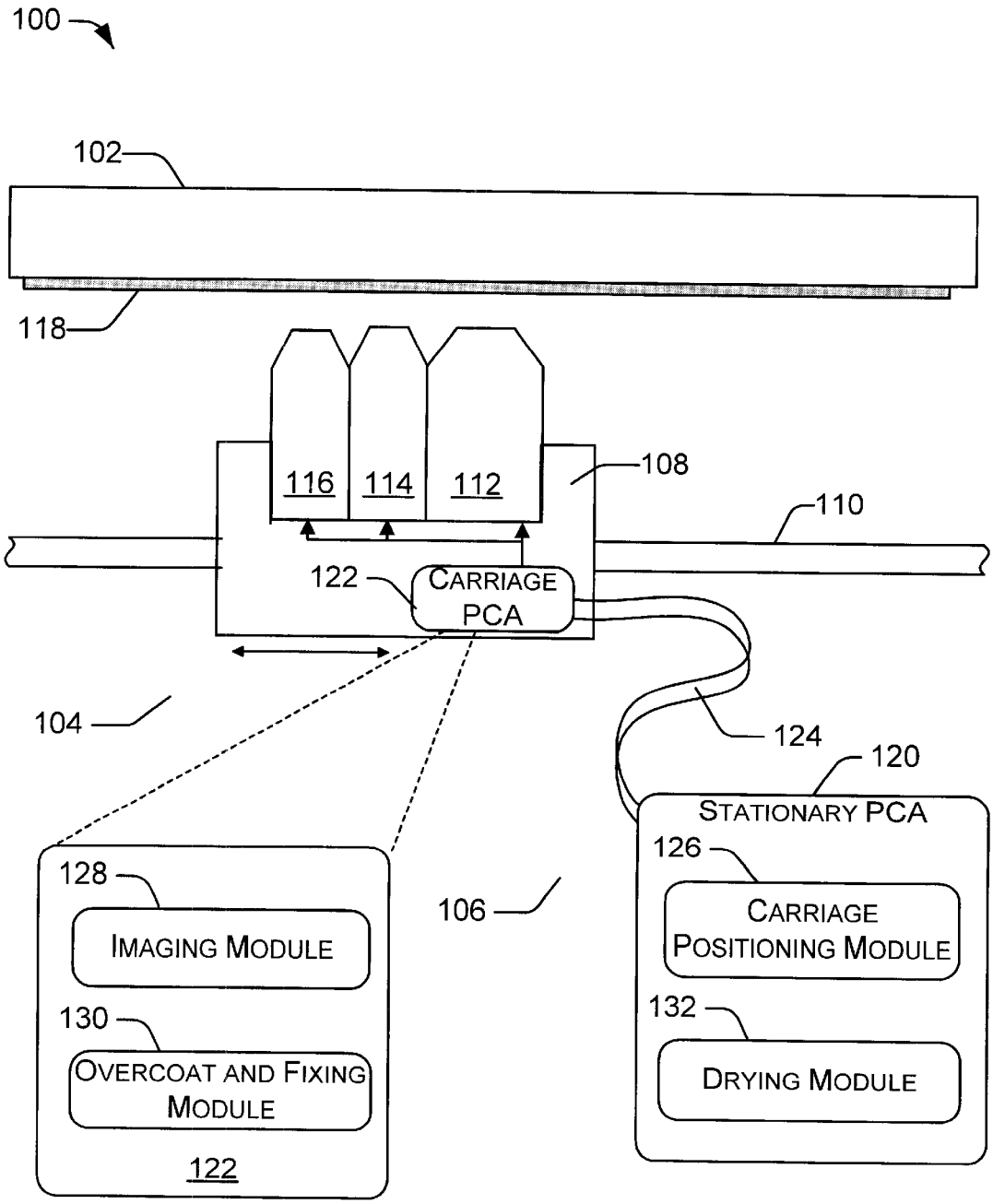
FIG. 1 shows a portion of an exemplary shuttle-type printer to reduce ink jet image smearing and increase image abrasion resistance in accordance with the present invention.

FIG. 1 shows an exemplary shuttle-type printer 100 and particularly, the printing mechanism portion of the printer. In this illustration, the shuttle-type printer 100 is configured as an ink jet printer, although other configurations are also possible, such as dot matrix, daisy wheel, thermal, and so forth. The shuttle-type printer 100 includes a platen 102, a shuttle assembly 104, and a control system 106.

The platen 102 is a stationary or rotatable element that supports a recording media during printing. The shuttle assembly 104 includes a carriage 108 slidably mounted on a fixed, elongated rod 110 to move bi-directionally across the platen 102 in reciprocating passes. The shuttle assembly 104 also includes a drive subassembly (not shown), such as a stepper or DC motor mechanically linked to the carriage to mechanically maneuver the carriage 108 back and forth along the rod 110.

The shuttle assembly 104 has three or more ink jet pens 112–116 fixed or removably mounted (e.g., replaceable, disposable pens) to the carriage 108. When mounted in the carriage 108, the pens 112–116 are disposed adjacent to, but spaced slightly from, the platen 102. A media feed mechanism (not shown), such as friction rollers or a tractor feed subassembly, advances the recording media 118 through the printer 100 and between the platen 102 and the printheads 112–116. Recording media 118 is paper media or glossy media. The carriage 108 carries the printheads 112–116 in a reciprocating motion over the printing surface 118. Each print sweep is called a "swath."

Each pen 112–116 essentially forms an entire printhead. As used herein, the terms "pen" and "printhead" are substantially interchangeable. Although there can be more or less than three (3) pens, 3 pens are illustrated herein for explanation purposes—a colorant pen 112, an overcoat pen 114, and a fixer pen 116. Each pen 112–116 includes a nozzle pattern formed at the pen tip, and a pen integrated circuit (IC) with heating elements (i.e., resistors) and selection logic for those elements. Alternatively, piezoelectric ink ejection elements may be used.

The colorant pen 112 includes a self-contained ink or colorant supply to deposit ink colorant to a printing surface 118. The overcoat pen 114 includes a self contained overcoat that is deposited over the ink colorant to protect the image. For instance, the self contained overcoat solution contained in pen 116 can be an acrylate polymer that is soluble in aqueous solution by virtue of a carboxylate salt (R-COOX where X=Na, K or NR'4). This polymer is made from monomers chosen such that they form a good film to protect the image. However, these polymers of pen 114 are themselves soluble in water without the use of the fixer solution of pen 116.

The fixer pen 116 includes a fixer solution having any of a set of reasonable chemical compositions to render the acrylate polymer from the described overcoat pen 114, insoluble and immobile when exposed to water. The fixer solution includes low molecular weight polymers with extremely high charge density. This means that the fixer solution will be able to react quickly with the acrylate polymer from the overcoat. The comparatively lower molecular weight of the fixer solution polymers lowers the entropy barriers, allowing the reaction to proceed quickly.

The dual polymer system is deposited from the respective printheads 114 and 116 over an ink colorant, react with one another when combined on the print media surface 118 to precipitate and strongly adhere to the print media 118. There are large entropy barriers to re-dissolution into water, as well as simple solubility of the combined salt. This method therefore forms a barrier between a printed image and a hostile environment, such as water.

Accordingly, the system 100 maintains the overcoat and fixer chemistries in separate pens 114 and 116, separate from the ink colorant solution. This means that the cationic binder of the fixer of pen 116 is decoupled from the ink. In this way, the ink of pen 112 remains reliable with excellent image quality, while the amount of binder available from a separate pen 114 is limited only by the carrying capacity of the pen 114 for the liquid. For instance, binders in thermal ink jet (TIJ) inks typically exhibit reliability issues at levels of about 2% by weight. However, system 100 is able to deliver binder solutions with ranges as high as 8–10%, or more, in overcoat solutions.

With respect to pen reliability and safety, consider that conventional systems may utilize a single pen to deposit protective fluid over a formed ink image. This means that all the protective functionality or chemistry in conventional systems needs to be in this single pen. When ink colorant is water soluble, it is desirable to have a non-water-soluble protective coating over the ink. To accomplish this, conventional systems that place all protective chemistry needs in a single pen may utilize an alcohol-soluble resin such as rosin, shellac, dammer gum, and/or the like. These alcohols in the processing fluid of the single pen have flammability and toxicity issues. Moreover, such polymers are known to give terrible reliability issues because any loss of co-solvent or water (if present) around the nozzle will dry the polymers in the single protective processing pen, and they can't be re-dissolved. Thus, the single processing pen of this example is generally flammable and/or toxic, and is easily permanently dried out.

In contrast to such a conventional system, the system 100 utilizes a water-soluble overcoat from pen 114 and an additional fixer solution from a separate, independent pen 116 to 'fix' or render the previously deposited polymers insoluble on the page. This dual polymer pen system 100 maintains the reliability and safety of each of its pens in this manner, including the ink colorant pen 112, the protective overcoat pen 114, and the fixer pen 116.

The exemplary control system 106 includes a stationary printed circuit assembly (PCA) 120 mounted to a stationary fixture of the printer, such as the frame or housing. The stationary PCA 120 functions as the primary logic or motherboard and controls non-pen related aspects of an imaging operation. The stationary PCA 120 includes carriage positioning circuitry 126, imaging circuitry 128, overcoat and fixing circuitry 130, and optional drying circuitry 132. The positioning circuitry or module 126 to manage the movement and position of the carriage 108 over the recording media 118 by moving the shuttle assembly 104 at a selectable velocity, known as the "slew rate", during the swaths over the recording media.

The stationary PCA 120 may also function as the primary logic or motherboard and may include I/O circuitry to handle I/O tasks with external devices (e.g., a host computer) and data/control format circuitry to format the data received from a host device such as a general purpose computer via the I/O circuitry into a serial bit stream that is sent to the carriage PCA 122, along with power and other control signals, over the communication path 124.

The carriage PCA 122 may include the imaging module 128 and the overcoat and fixer module 130 to respectively control pen 112–116 solution deposition or firing aspects of the image formation and protection process. The carriage PCA 122 has an input connector that couples to the conductor cable 124 to receive power, ground signals, and data from the stationary PCA 120. The carriage PCA 122 includes a pair of pen connectors (not shown) or conductive contacts that electrically couple to contact pads formed on the pens 112–116. The contact pads on the pens 112–116 engage the contacts of the carriage PCA 122 when the pens 112–116 are installed on the carriage 108. The particular pen 112–116 being fired by a module 128 or 130 at any one time depends on whether an image is presently being formed or whether the printed image is being protected from smears and abrasion. For instance, when the stationary PCA 120 communicates signals and a formatted image data stream across the communication path 124, the imaging module 128 activates one or more ink colorant pens 112 to deposit ink onto the print media 118 according to one or more established algorithms for forming black and white, grayscale, or color images.

Additionally, when the stationary PCA 120 communicates a signal indicating that a protective coating is to be applied to the receiver 118, the overcoat/fixer module 130 activates pens 114 and 116 to respectively apply an acrylate polymer "overcoat" and fixer solution to the image receiver 118. The "overcoat" of pen 114 may overlie or underlie ink colorant from pen 112 as discussed in greater detail below. The fixer of pen 116 may be applied serially (one before the other) or in combination (as a mixture) with the acrylate polymer of pen 114.

The overcoat and fixer solutions of pens 114 and 116 are applied after the deposition of the ink colorant by pen 112 onto the print media 118, such that enough polymer chains are insoluble to protect the image. For example, after forming an image on the print receiver 118, image drying circuitry 132 can be used to control a drying mechanism to dry the newly printed image before the overcoat and fixing module 130 overlays the printed image with the described dual polymer system, which preferably includes anionic acrylate and the positively charged amine containing polymer (deposited from the respective printheads 114 and 116 over the ink colorant).

Paper can only tolerate a certain amount of water per unit area before it starts to cockle. Drying deposited ink colorant substantially maximizes the amount of fixer/overcoat that can be applied to the print medium, thus improving smear proofing. Once the ink colorant is substantially dried, the print medium is able to tolerate additional water being applied to it substantially without cockling. So, depositing ink colorant, and then drying the print medium, allows for substantially more overcoat and fixer to be applied over the ink colorant than would have otherwise been possible if the ink colorant and the overcoat/fixer had been deposited at the same time. Additionally, separation of the printing and the print protection processes into separate pens 112–116 (i.e., separate print and print protection zones) further allows use of a high volume pen 112 and/or 116 to deposit larger amounts of overcoat and/or fixer.

Figure 2:
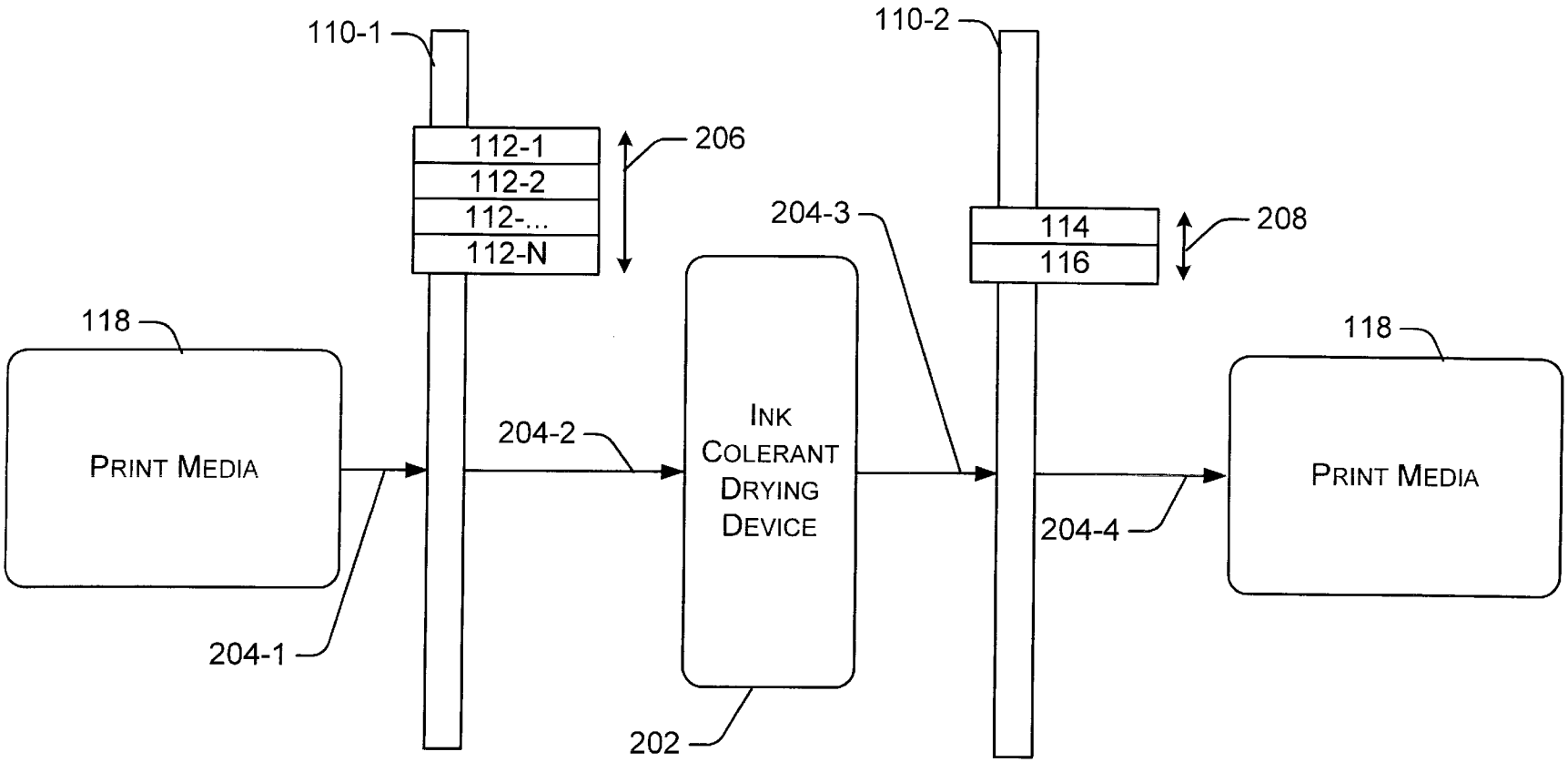
FIG. 2 shows further aspects of an exemplary system to form and protect images formed on print media. In particular.

FIG. 2 shows further aspects of an exemplary system 100 to form and protect images formed on print media 118. In this example, the drying mechanism 202 is utilized by the image drying module 132 to dry an image on the print receiver 118 before the overcoat and fixing module 130 overlays the printed image with the described dual polymer system deposited from the respective printheads 114 and 116 over the ink colorant.

The path of the recording media 118 through the printing device 100 is indicated by directional arrows 204. Specifically, the media enters the imaging device 100 from the left of FIG. 2, as indicated by directional arrow 204-1. As the media 118 is fed along the printing path 204 towards the dryer 202 (see, arrow 204-2), one or more ink colorant printheads 112 are moved along the carriage 110-1 to print swaths of ink colorant over the media 118 in an image printing zone defined by the directional swaths 206, as indicated by arrow 206.

To form a substantially smudge-resistant image on a receiver 118, a protective overcoat of fluid will be applied by pens 114 and 116 over the ink colorant deposited by the pen(s) 112. However, each type of print media has a respective fluid wicking or capillary absorption property limitation. This means that only so much solution, whether it is ink and/or an overcoat solution, can be placed onto print media 118 over a period of time before the solution is no longer absorbed through capillary action. When the ink receiver is unable to adequately absorb additional fluid, undesired imaging defects are typically exhibited such as paper cockle, image run, and so on. Yet, the more overcoat solution that can be applied and absorbed into the ink receiver 118 and the ink colorant deposited by pen 112, typically the better the smudge resistant properties o f the formed image.

To increase the smudge resistance properties of a formed image without causing undesired imaging defects, the system 100 increases the relative absorption capabilities of the ink receiver 118 proximal to where the image has already been formed. Specifically, after the ink colorant from pen 112 has been formed onto the receiver 118, the drying device 202 substantially dries the receiver 118 and the deposited ink before the described dual polymer protective coating of pens 114 and 116 is applied. This substantially increases the relative wicking properties of the ink received proximal to the deposited ink colorant. Additionally, because the receiver 118 will not be saturated when any overcoat protection is applied, undesired defects such as paper cockle, ink runs, and so on, will not be exhibited in the formed image.

The drying device can be any sort of device (e.g., any one or combination of a conductive, radiant, convective, delay heater, a heating element, blower, etc.) to reduce a relative drying time of the colorant solution deposited by the pen(s) 112 and the corresponding area of the ink receiver 118.

As the recording media 118 is moved out of the drying device 202 (see, the directional arrows 204-3 and 204-4), a protective overcoat and fixer is applied over the top of the deposited ink colorant on the recording media. This dual polymer system, which preferably includes anionic acrylate and the positively charged amine containing polymer, is applied as the overcoat pen 114 and the fixer pen 116 respectively move in the axis of the carriage 110-2 in an image protecting zone defined by the directional swaths 208, as indicated by arrow 208.

Accordingly, the exemplary system 100 of FIG. 2 divides or breaks-up the printing and protective overcoat process into multiple, independent operations. This provides for ink colorant solution drying time before any application of the respective protective overcoat and fixer solutions of pens 114 and 116.

Figure 3:
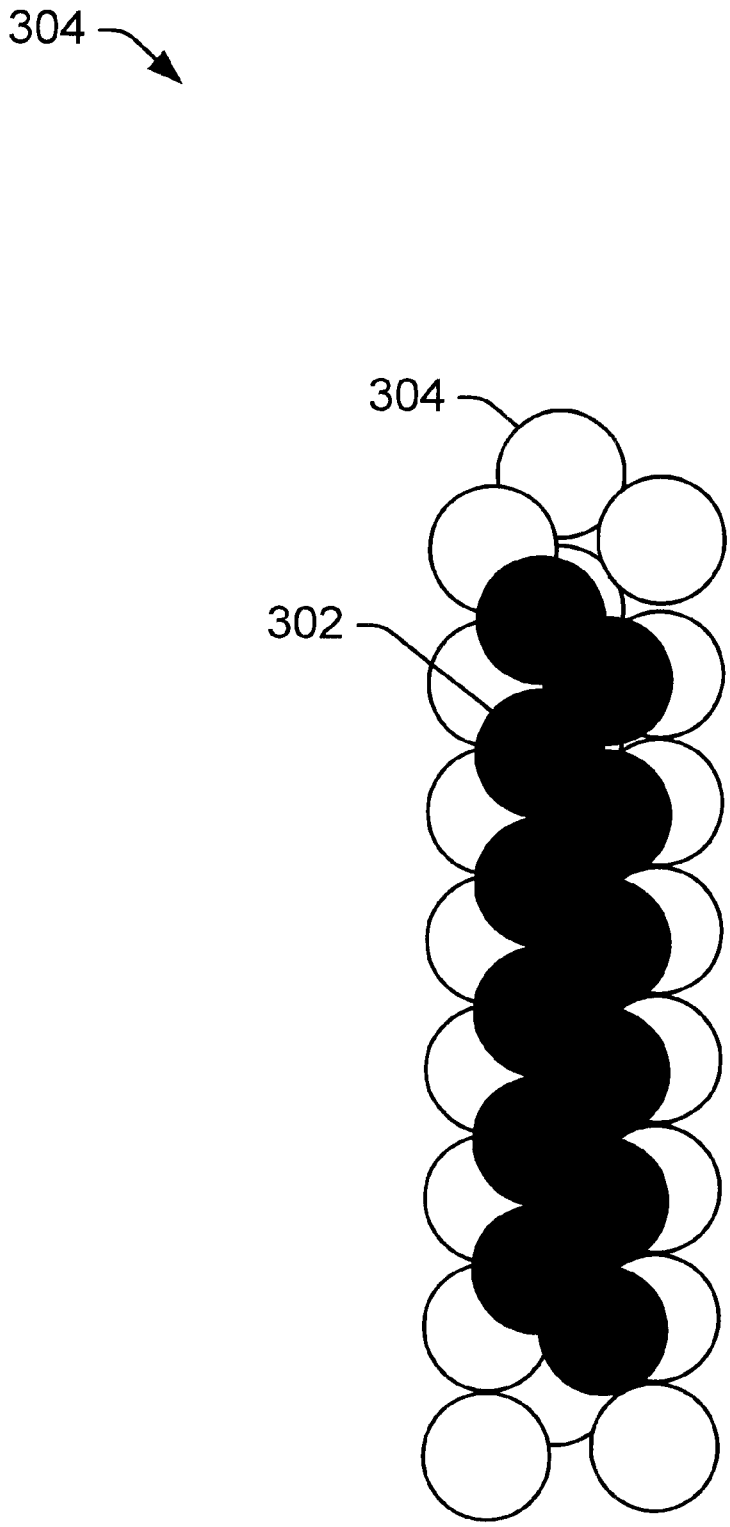
FIG. 3 shows an exemplary application of droplets of ink colorant pen, which have been overlaid or "bloomed" with respective overcoat and fixer solutions to protect the ink droplets from smudges.

FIG. 3 shows an exemplary image 300 formed by application of droplets from the ink colorant pen 112, which have been overlaid with a protective coating and fixer solution, the solution corresponding to droplets 304 deposited respectively by overcoat and fixer pens 114 and 116. When an overcoat is used for smudge-free ink jet printing, edges of a printed image will generally still smudge unless the overcoat overlaps the edges of the printed image. However, as illustrated in FIG. 3, ink colorant droplets 302 are first applied to a printed receiver 118, and then the droplets are covered with corresponding protective overcoat and fixer droplets 304. These droplets 304 seal the edges of the ink droplets 302 by "blooming", or forming a protective coating some number of dot rows beyond the edges of the ink droplets 302.

The same image forming data stream that is used to form the ink dots 302 can be slightly modified to generate a bloomed data stream of overcoat and fixer dots 304. In this manner, the edges of the ink droplets 302 are sealed with a protective coating 304 for water-fastness and smudge resistance.

An Exemplary Procedure

Figure 4:
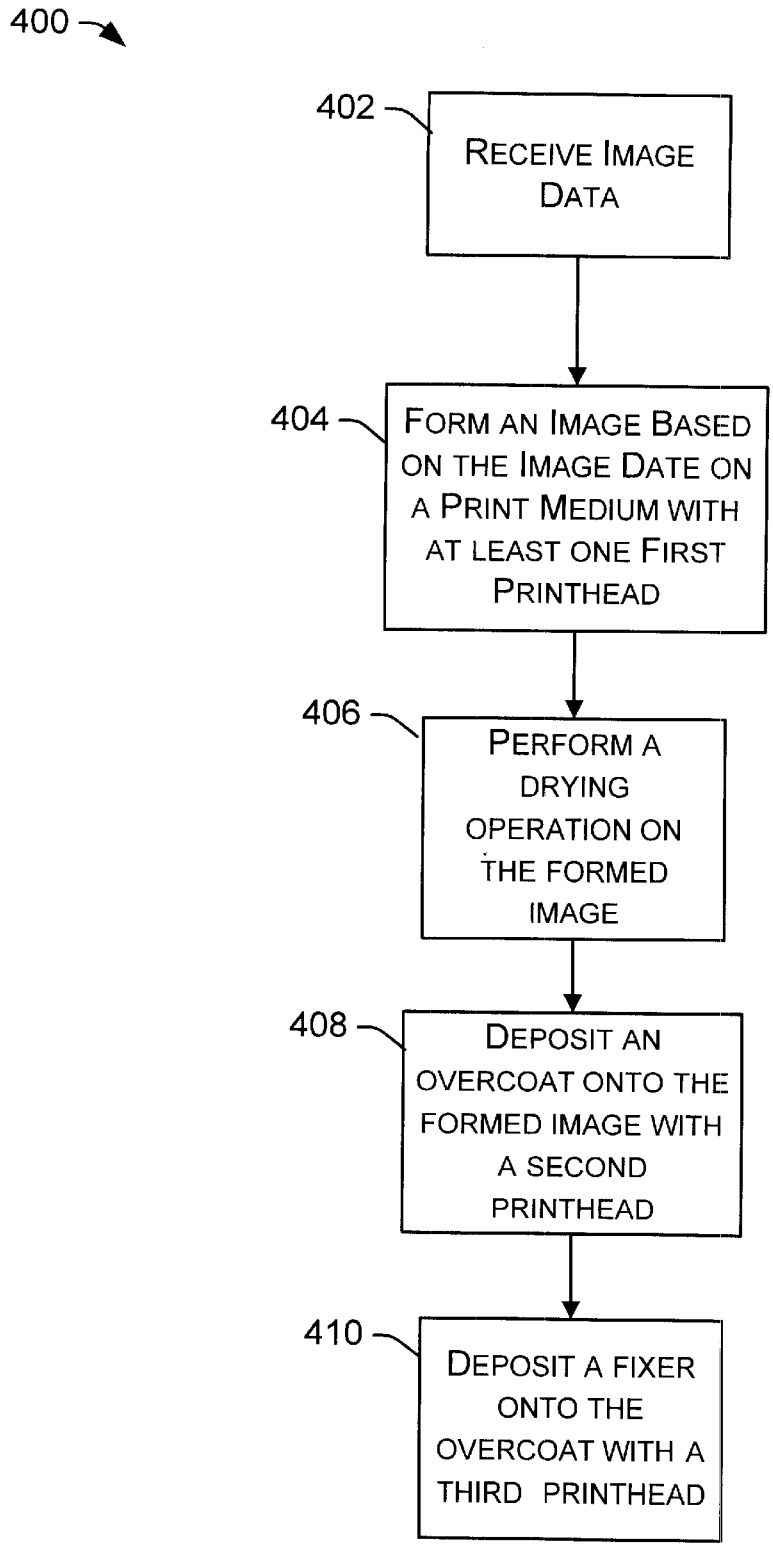
FIG. 4 shows an exemplary procedure to form a substantially smudge resistant image on print media.

FIG. 4 shows an exemplary procedure 400 to form a substantially smudge resistant image on an ink colorant or print receiver. At block 402, image data is received by an imaging device such as a printer, copier, facsimile machine, and the like. At block 404, an image based on the received image data (block 402) is formed onto an ink colorant receiver (e.g., paper). At block 406, the formed image or portions of the formed image are optionally dried to increase the relative absorption properties of the ink receiver and/or the deposited ink colorant edge acuity and chroma (block 404).

At block 408, an overcoat is deposited over the formed and optionally dried image. This overcoat includes, for example, an acrylate polymer that is soluble in aqueous solution by virtue of a carboxylate salt (R-COOX where X=Na, K or NR'4). This polymer is made from monomers chosen such that they form a good film to protect the image from contact with water. However, these overcoat polymers are themselves soluble in water without the combination of a fixer solution (i.e., such as the described fixer solution of pen 116). This solubility until mixed with fixer solution provides improved reliability of the overcoat solution.

At block 410, a fixer solution is applied or combined with the deposited overcoat (block 408). The fixer solution has any of a set of reasonable chemical compositions to render the acrylate overcoat polymer insoluble and immobile when exposed to water. Such a fixer solution includes, for example, low molecular weight polymers with extremely high charge density.

Exemplary Ink Jet Pens

Ink jet pens that are used to eject colorants, such as pens 112-1 through 112-N in FIG. 2, must eject very small drop volumes in order to create a sharp image, since the drops form the visible pattern of pixels on the print media. Typical ink jet pens for color inks eject drops of approximately 4 pl (picoliters), and typical pens for black ink eject drops of approximately 18 pl. The overcoat and fixer of the present invention, however, are clear, and therefore the pens used to eject them (such as pens 114 and 116 in FIG. 2) do not have a similar drop-volume constraint. Indeed, a higher drop volume for the overcoat and fixer pens may obviate the need for "blooming" of the overcoat and fixer, since larger drops of overcoat and fixer would inherently tend to overlap the edges of the visible image.

Moreover, small drop volume pens may be unreliable when used to eject fluids having high levels of polymers as a percentage of volume (and, as discussed above, the higher the polymer level, generally the better the smudge-fast performance). Therefore, to maximize performance and reliability, it is preferred that the pens used to eject overcoat and fixer in the present invention be high drop-volume pens. The pens preferably have a drop volume of approximately 32 pl, but may have drop volumes in the range of approximately 4 pl to approximately 64 pl.

Conclusion

Although the subject matter has been described in language specific to structural features and/or methodological operations, it is understood that the arrangements and procedures defined in the appended claims is not necessarily limited to the specific features or operations described. Rather, the specific features and operations are disclosed as preferred forms of implementing the claimed subject matter.

What is claimed is:

1. A method for generating a smudge resistant image with an ink jet imaging device, the method comprising:

generating, using a first carriage in an image printing zone, an image on a print medium;

depositing, using a second carriage in an image protecting zone, an overcoat solution and a fixer solution onto the image to form a substantially smudge resistant image;

wherein generating the image further comprises depositing, with a first printhead of the imaging device, an ink colorant onto a print medium to form an image, the first printhead being independent of a second and a third printhead of the imaging device;

wherein depositing the overcoat solution further comprises depositing, by the second printhead, an overcoat solution over the image to protect the image from abrasions, the overcoat solution being water soluble;

wherein depositing the fixer solution further comprises depositing, by the third printhead, a fixer to the overcoat solution, the fixer being water soluble; and wherein the overcoat in combination with the fixer are water insoluble and hence substantially protect the image from smudges.

2. A method for generating a smudge resistant image with an ink jet imaging device, the method comprising:

generating, using a first carriage in an image printing zone, an image on a print medium;

depositing, using a second carriage in an image protecting zone, an overcoat solution and a fixer solution onto the image to form a substantially smudge resistant image;

wherein generating the image is performed by at least one first pen positioned on the first carriage; and wherein depositing the overcoat and fixer solution is performed by at least one second pen positioned on the second carriage wherein the at least one second pen has a drop volume greater than the drop volume of the at least one first pen;

and wherein the at least one second pen has a drop volume in the range of 4 pl to 64 pl.

* * * * *